US011201388B2

(12) United States Patent
Zimmerman et al.

(10) Patent No.: US 11,201,388 B2
(45) Date of Patent: Dec. 14, 2021

(54) BASE STATION ANTENNAS THAT UTILIZE AMPLITUDE-WEIGHTED AND PHASE-WEIGHTED LINEAR SUPERPOSITION TO SUPPORT HIGH EFFECTIVE ISOTROPIC RADIATED POWER (EIRP) WITH HIGH BORESIGHT COVERAGE

(71) Applicant: CommScope Technologies LLC, Hickory, NC (US)

(72) Inventors: Martin L. Zimmerman, Chicago, IL (US); Björn Lindmark, Sollentuna (SE)

(73) Assignee: CommScope Technologies LLC, Hickory, NC (US)

( * ) Notice: Subject to any disclaimer, the term of this patent is extended or adjusted under 35 U.S.C. 154(b) by 222 days.

(21) Appl. No.: 16/357,449

(22) Filed: Mar. 19, 2019

(65) Prior Publication Data

US 2019/0326662 A1 Oct. 24, 2019

Related U.S. Application Data

(60) Provisional application No. 62/646,402, filed on Mar. 22, 2018.

(51) Int. Cl.
*H01Q 1/24* (2006.01)
*H01Q 5/25* (2015.01)
(Continued)

(52) U.S. Cl.
CPC ..... *H01Q 1/246* (2013.01); *H01Q 3/34* (2013.01); *H01Q 5/25* (2015.01); *H01Q 21/22* (2013.01); *H01Q 21/30* (2013.01)

(58) Field of Classification Search
CPC ..... H01Q 1/246; H01Q 5/25; H01Q 3/34; H01Q 3/36; H01Q 3/28; H01Q 21/22; H01Q 21/30; H01Q 25/002; H01Q 25/001
See application file for complete search history.

(56) References Cited

U.S. PATENT DOCUMENTS 5,936,577 A 8/1999 Shoki et al.
5,959,578 A * 9/1999 Kreutel, Jr. ..... H01Q 3/26 342/373
(Continued)

FOREIGN PATENT DOCUMENTS

CN 1878023 A 12/2006

OTHER PUBLICATIONS

Notification of Transmittal of the International Search Report and the Written Opinion of the International Searching Authority, or the Declaration, in corresponding PCT Application No. PCT/US2019/022849 (dated Jun. 21, 2019).
(Continued)

*Primary Examiner* — Awat M Salih
(74) *Attorney, Agent, or Firm* — Myers Bigel, P.A.

(57) ABSTRACT

A base station antenna (BSA) system includes a radio-frequency (RF) generator having a plurality of power-amplifying circuits therein, and an antenna, which includes a plurality of columns of radiating elements. These radiating elements are electrically coupled by RF signal routing to a corresponding plurality of ports of the antenna that receive a corresponding plurality of RF input signals. These RF input signals have respective amplitudes and phases that support the concurrent generation of three spaced-apart RF beams by the antenna and are derived from respective RF signals generated by the plurality of power-amplifying circuits. The RF input signals including: (i) a first RF input signal defined by at least two linearly superposed RF signals of equivalent frequency having unequal combinations of
(Continued)

amplitude and phase weighting, and (ii) a second RF input signal defined by at least two linearly superposed RF signals of equivalent frequency having unequal combinations of amplitude and phase weighting.

20 Claims, 11 Drawing Sheets

(51) Int. Cl.
*H01Q 3/34* (2006.01)
*H01Q 21/22* (2006.01)
*H01Q 21/30* (2006.01)

(56) References Cited

U.S. PATENT DOCUMENTS

2003/0162566 A1* 8/2003 Shapira ..... H04B 7/10 455/561
2005/0164664 A1 7/2005 Difonzo et al.
2006/0003808 A1 1/2006 Haskell et al.
2006/0068848 A1 3/2006 Shapira et al.
2012/0001801 A1* 1/2012 Adams ..... H01Q 3/26 342/368
2015/0372397 A1* 12/2015 Jonsson ..... H01Q 21/26 343/835
2020/0358177 A1* 11/2020 Ge ..... H01Q 3/267

OTHER PUBLICATIONS

Ma et al. "Design of passive vector sum phase shifters" 2012 International Conference on Microwave and Millimeter Wave Technology (ICMMT) (May 5, 2012).
Chinese Office Action Corresponding to Chinese Patent Application No. 201980019885.0 (Foreign Text, 6 Pages, English Translation Thereof, 7 Pages) (dated Sep. 3, 2021).

* cited by examiner

65° Single Beam

38° 2-BEAM

24° 3-BEAM

BASE STATION ANTENNAS THAT UTILIZE AMPLITUDE-WEIGHTED AND PHASE-WEIGHTED LINEAR SUPERPOSITION TO SUPPORT HIGH EFFECTIVE ISOTROPIC RADIATED POWER (EIRP) WITH HIGH BORESIGHT COVERAGE

REFERENCE TO PRIORITY APPLICATION

This application claims priority to U.S. Provisional Patent Application Ser. No. 62/646,402, filed Mar. 22, 2018, the disclosure of which is hereby incorporated herein by reference.

FIELD OF THE INVENTION

The present invention relates to radio communications and antenna devices and, more particularly, to base station antenna arrays for cellular communications and methods of operating same.

BACKGROUND

Wireless communications systems often use phased-array radiating elements to electronically steer a beam of radio waves in varying directions without physical movement of the radiating elements therein. As shown by FIG. 1A, in a phased array antenna 10, radio frequency ("RF") feed current is provided from a transmitter (TX) to a plurality of spaced-apart antenna radiating elements via a power divider network that splits the RF feed current into a plurality of sub-components. Each radiating element may transmit a respective sub-component of the RF feed current into free space. As is also shown in FIG. 1A, phase shifters ($\Phi_1$-$\Phi_8$) may optionally be provided between the power divider and the radiating elements that can be used to establish a desired phase relationship between the radio waves emitted by the spaced-apart radiating elements. The phase shifters may be used, for example, to apply an electronic downtilt to the antenna beam in the vertical or "elevation" plane. The phase shifters ($\Phi_n$) may be fixed phase shifts (e.g., implemented as transmission lines having varying lengths) or may be adjustable phase shifters that can be controlled by a computer control system (CONTROL). In either case, the phase shifters can be used to set the relative phases of the radio waves emitted by the respective radiating elements in order to change the shape of the radiation pattern in a desired fashion. Providing a radiation pattern having a desired shape can be important when the phased array antennas are used in cellular communication and other RF-based systems.

For example, in a typical cellular communications system, a geographic area is often divided into a series of regions that are commonly referred to as "cells", which are served by respective base stations. Each base station may include one or more base station antennas (BSAs) that are configured to provide two-way RF communications with mobile subscribers that are within the cell served by the base station. In many cases, each base station is divided into "sectors." In the most common configuration, a hexagonally shaped cell is divided into three 120° sectors. Each sector is served by one or more base station antennas, and each antenna can have an azimuth Half Power Beam Width (HPBW) of approximately 65° in order to provide good coverage throughout the 120° sector, as shown by the normalized single beam plot of FIG. 1B. Typically, the base station antennas are mounted on a tower or other raised structure and the radiation patterns (a/k/a "antenna beams") are directed outwardly therefrom. As discussed above, base station antennas are often implemented as linear phased arrays of radiating elements (with many base station antennas including multiple independent linear arrays), and in some cases base station antennas include planar arrays of radiating elements.

In order to accommodate the ever-increasing volumes of cellular communications, cellular operators have added cellular services in a variety of new frequency bands. While in some cases it is possible to use linear arrays of so-called "wide-band" or "ultra wide-band" radiating elements to provide service in multiple frequency bands, in other cases it is necessary to use different linear arrays (or planar arrays) of radiating elements to support service in the different frequency bands.

SUMMARY

A base station antenna according to embodiments of the invention includes a plurality of columns of radiating elements electrically coupled by RF signal routing to a corresponding plurality of ports of the antenna that receive, when active, a corresponding plurality of RF input signals having respective amplitudes and phases that support the concurrent generation of three spaced-apart RF beams by the antenna. The plurality of ports include at least a first port configured to receive a first of the plurality of RF input signals. This first of the plurality of RF input signals includes at least two linearly superposed RF signals of equivalent frequency having unequal combinations of amplitude and phase weighting.

According to some embodiments of the invention, the plurality of columns of radiating elements includes eight (8) columns of radiating elements. And, the three spaced-apart RF beams include a pair of RF beams, which are mirror-images of each other relative to a plane aligned to a boresight of the antenna, and a central RF beam extending between the pair of RF beams. In some of these embodiments of the invention, the respective amplitudes of the plurality of RF signals are sufficient to yield a less than 20% weighting loss across all of the plurality of columns of radiating elements. In addition, the plurality of ports may include at least a second port configured to receive a second of the plurality of RF input signals, which includes at least two linearly superposed RF signals of equivalent frequency having unequal combinations of amplitude and phase weighting. The first and second ports may be electrically coupled to the third and sixth columns of radiating elements, respectively.

In further embodiments of the invention, the combinations of amplitude and phase weighting associated with the first of the plurality of RF input signals matches the combinations of amplitude and phase weighting associated with the second of the plurality of RF input signals. The first of the plurality of RF input signals may include two linearly superposed RF signals of equal magnitude that are out of phase by approximately 180°.

According to additional embodiments of the invention, the radiating elements are dual-polarized radiating elements, and the plurality of columns of radiating elements are electrically coupled by respective RF signal routing to corresponding ports of the antenna. This RF signal routing may include at least a first multi-output phase shifter having an input configured to receive the at least two linearly superposed RF signals associated with the first of the plurality of RF input signals. The antenna may also include a diplexer having first and second inputs for receiving respective RF signals having unequal frequencies, and a phase shifter having: (i) an input electrically coupled to a diplexed output of the diplexer, and (ii) a plurality of outputs electrically coupled to a plurality of radiating elements in a first of the plurality of columns of radiating elements. The radiating elements in the plurality of columns of radiating elements may be dual-band and dual-polarized radiating elements, which are electrically coupled in pairs to the plurality of outputs of the phase shifter.

According to additional embodiments of the invention, a base station antenna system is provided with a radio-frequency (RF) generator having a plurality of power-amplifying circuits therein, and an antenna including a plurality of columns of radiating elements electrically coupled by RF signal routing to a corresponding plurality of ports of the antenna that receive a corresponding plurality of RF input signals. These RF input signals, which have respective amplitudes and phases that support the concurrent generation of three spaced-apart RF beams by the antenna, are derived from respective RF signals generated by the plurality of power-amplifying circuits. The plurality of RF input signals include: (i) a first RF input signal including at least two linearly superposed RF signals of equivalent frequency having unequal combinations of amplitude and phase weighting, and (ii) a second RF input signal including at least two linearly superposed RF signals of equivalent frequency having unequal combinations of amplitude and phase weighting. In some of these embodiments of the invention, the combinations of amplitude and phase weighting associated with the first RF input signal matches the combinations of amplitude and phase weighting associated with the second RF input signal. The first RF input signal may include two linearly superposed RF signals that are out of phase by approximately 180°, yet have equivalent magnitudes.

According to further embodiments of the invention, the antenna may include eight columns of radiating elements, and the signal routing may be configured to route the first and second RF input signals to the radiating elements in the fourth and fifth columns of the antenna. Each of these first and second RF input signals may include three linearly superposed RF signals of equivalent frequency having unequal combinations of amplitude and phase weighting.

According to another embodiment of the invention, a base station antenna is provided with first through eighth columns of dual-band radiating elements, and first through eighth diplexers, with each diplexer having first and second inputs that are electrically coupled to respective pairs of ports of the antenna. First through eighth phase shifters are also provided, with each phase shifter having an input electrically coupled to an output of a respective one of the diplexers and a plurality of outputs electrically coupled to the dual-band radiating elements in a respective one of the columns of dual-band radiating elements. The dual-band radiating elements in the columns of dual-band radiating elements are electrically coupled, in pairs, to respective ones of the plurality of outputs of the respective phase shifters. Each diplexer may be a comb-line filter.

According to a further embodiment of the invention, a base station antenna system is provided, which includes a plurality of columns of radiating elements, and a radio-frequency (RF) generator, which is electrically coupled by RF signal routing to the plurality of columns of radiating elements. The RF generator includes a first power-amplifying linear superposition circuit configured to generate at least two amplitude-weighted and phase-weighted RF transmission signals that are combined to thereby drive a portion of the RF signal routing associated with first one of the plurality of columns of radiating elements with a first RF signal that encodes the first plurality of amplitude-weighted and phase-weighted RF transmission signals. In some of these embodiments of the invention, the first power-amplifying linear superposition circuit may be configured to generate three amplitude-weighted and phase-weighted RF transmission signals. The first RF signal may encode these three amplitude-weighted and phase-weighted RF transmission signals.

DETAILED DESCRIPTION

Pursuant to embodiments of the present invention, base station antennas are provided that include a plurality of columns of radiating elements that may be configured to generate three spaced-apart beams in the azimuth plane. The three antenna beams may, for example, provide coverage for a 120° sector (in the azimuth plane) of a cellular base station.

The antenna beams may be generated by feeding at least two linearly superposed RF signals of equivalent frequency that have different amplitude and/or phase weights applied thereto to at least some of the columns of radiating elements.

In some embodiments, the base station antennas may have eight columns of radiating elements. The amplitude and phase weights may be selected so that a weighting loss may be kept low, and hence the antenna may maintain high effective isotropic radiated power (EIRP) levels. For example, in some embodiments, the weighting loss may be less than 20%. In other embodiments, the weighting loss may be less than 10%. In fact, in some embodiments, the weighting loss may be effectively zero or at least close to zero. Herein, the "weighting loss" refers to the reduction in EIRP that results from the amplitude taper applied to different columns of radiating element in forming the multiple antenna beams.

In some embodiments, the radiating elements may be wideband radiating elements that support operation in at least two different frequency bands. Diplexers may be provided for each column of radiating elements that connect the radiating elements of the column to a pair of radio ports that transmit in the different frequency bands. By using diplexers and wide band radiating elements, longer columns may be used that narrow the elevation beamwidth, thereby improving the gain of the antenna and hence the supportable EIRP level.

Figure 3A:
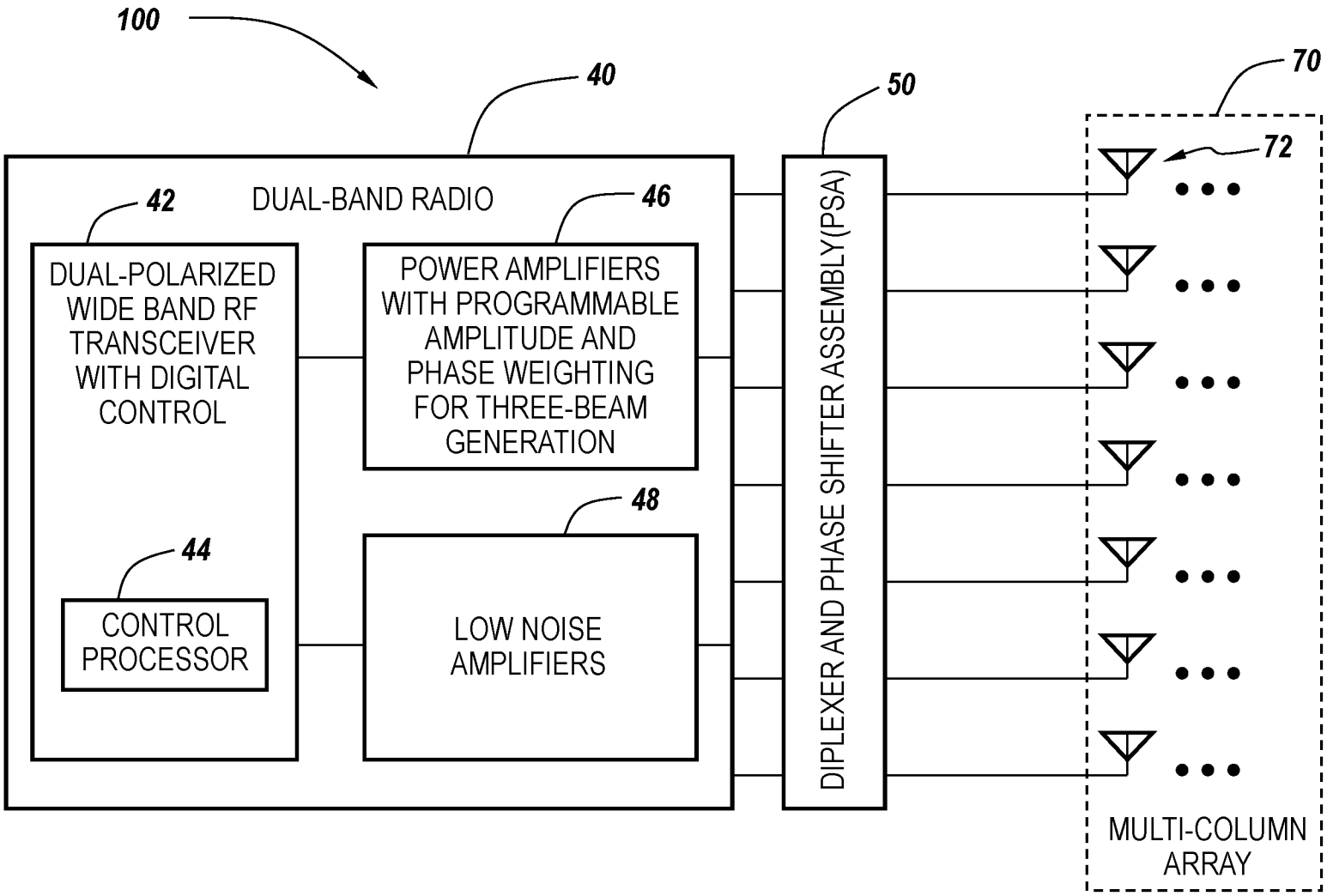
FIG. 3A is a functional block diagram of a base station antenna system that utilizes multiple columns of diplexed dual-polarized radiating elements, a wide band RF transceiver (TX/RX), and power amplifier circuits that support amplitude-weighted and phase-weighted linear superposition, according to an embodiment of the present invention.

Referring now to FIG. 3A, a base station antenna (BSA) system 100 according to an embodiment of the invention is illustrated that includes a multi-band radio 40, a diplexer and phase shifter assembly (PSA) array 50, and an antenna 70 containing a multi-column array of radiating elements 72 (e.g., 8-column array), such as dual-polarized (e.g., +45°, −45°), wide band radiating elements. As illustrated, the multi-band radio 40 may be a dual-polarized wide band RF transceiver (Tx/Rx) with digital control 42, and a control processor 44, which controls operations of the transceiver 42. As illustrated, on the transmission (Tx) side, the transceiver 42 is coupled to and drives power amplifiers 46 with RF signals to be transmitted (e.g., dual-band RF signals). And, on the receiver (Rx) side, the transceiver 42 receives RF signals output by low noise amplifiers LNA 48. As described more fully hereinbelow, the power amplifiers 46 may be embodied as digitally-controlled power-amplifying linear superposition circuits with programmable amplitude and/or phase weighting, which supports enhanced three-beam generation and low effective isotropic radiated power (EIRP) loss when the power amplifiers are advantageously run at full or nearly full power.

As further illustrated by FIG. 3A, the radio frequency output signals generated by the power-amplifying linear superposition circuits may be provided to an array of diplexers (to support multi-band operation) and an array of phase shifter assemblies 50, which drive the antenna 70. In some embodiments of the invention, the diplexers may be configured as comb-line filters having high Q-factor (e.g., approx. 1800) and relatively small dimensions (e.g., 81×41×20 mm). Advantageously, diplexers of small size may be more readily integrated between relatively narrowly-spaced columns of antenna radiating elements. The phase shifter assembly 50 that is provided for each column of radiating elements included in the antenna array 70 may split RF signals that are to be transmitted by the column into a plurality of sub-components, and each sub-component may be fed to a respective one of the radiating element (or to a commonly-fed sub-array of radiating elements) and may likewise combine the RF signals received at each radiating element (or sub-array) and pass the combined signal to the dual-band radio 40. Each phase shifter assembly 50 may also be configured to apply a phase taper to the sub-components of the RF signal that are passed to the respective radiating elements (or sub-arrays) in order to, for example, effect an electronic downtilt to the antenna beam. It will be appreciated that the phase shifter assemblies 50 may be simply comprise power splitter/combiners in some embodiments that do not perform any relative phase shifting of the sub-components of the RF signal.

Figure 3B:
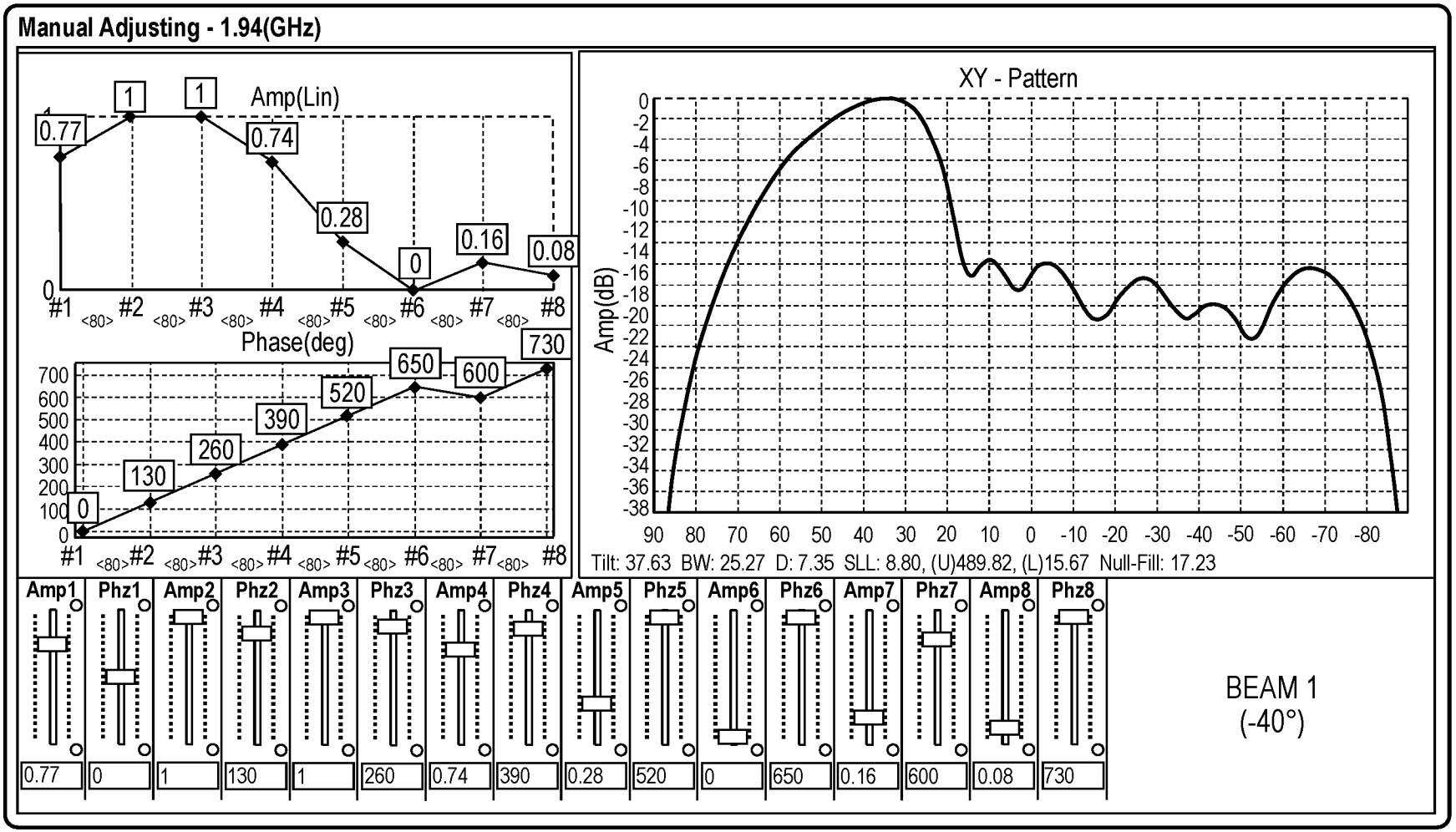
FIGS. 3B, 3C and 3D are simulated two-dimensional graphs of first through third antenna beams, respectively, that are generated by an 8-column base station antenna, along with graphs showing the amplitude-weights and phase-weights that are applied to the RF signals transmitted through each column of the base station antenna in order to generate the first through third antenna beams.
Figure 3C:
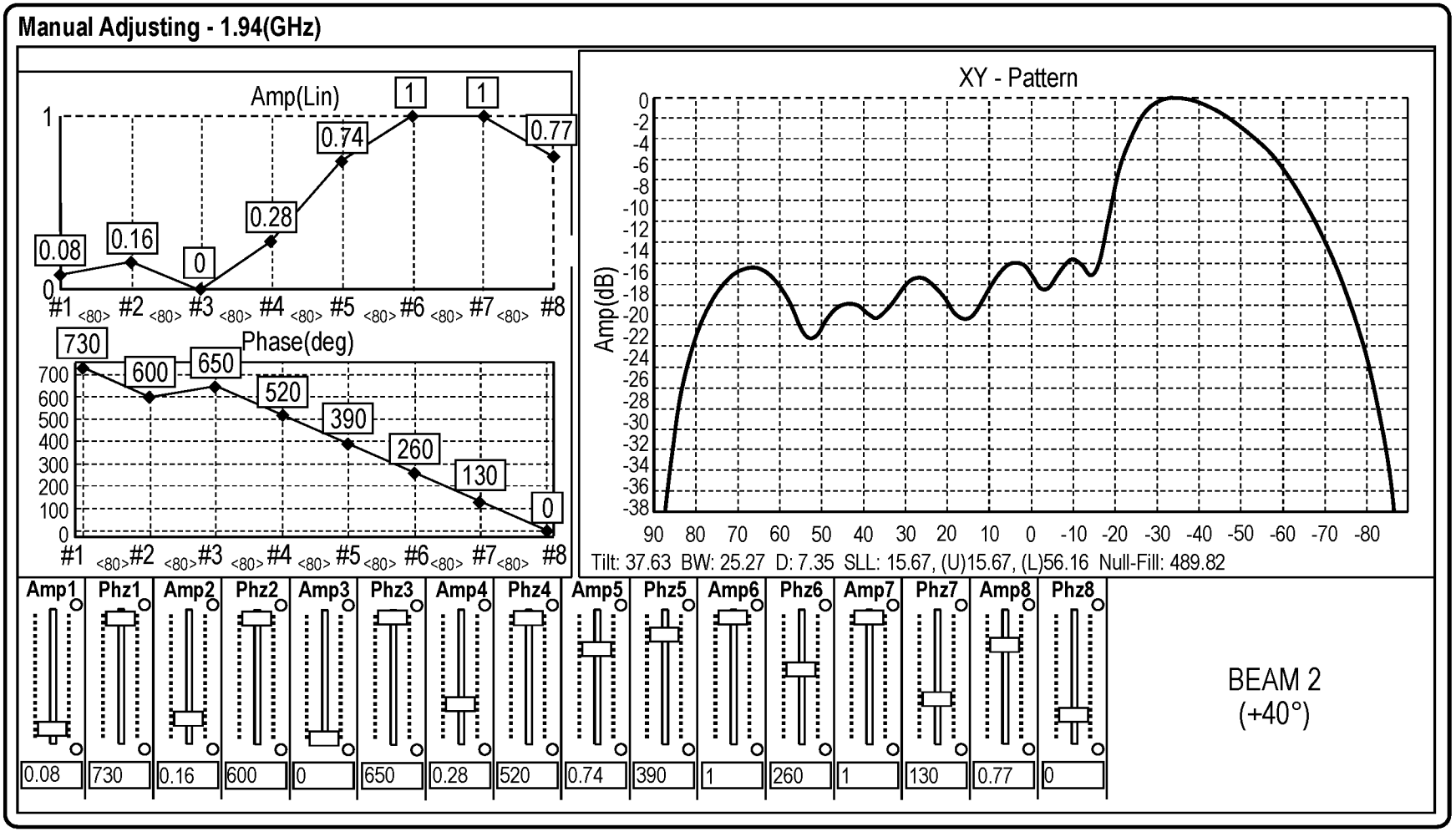
Figure 3D:
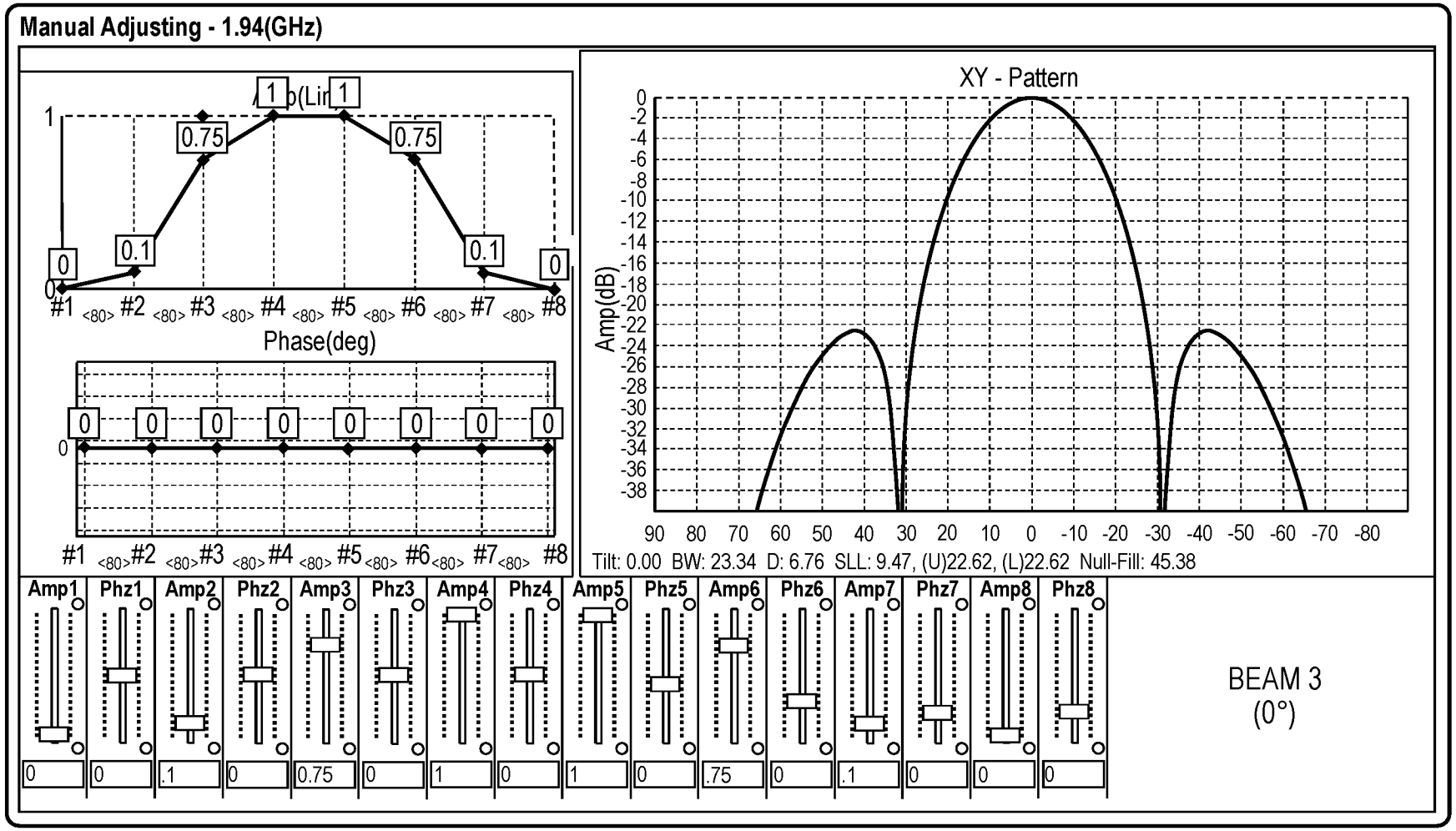
Figure 3E:
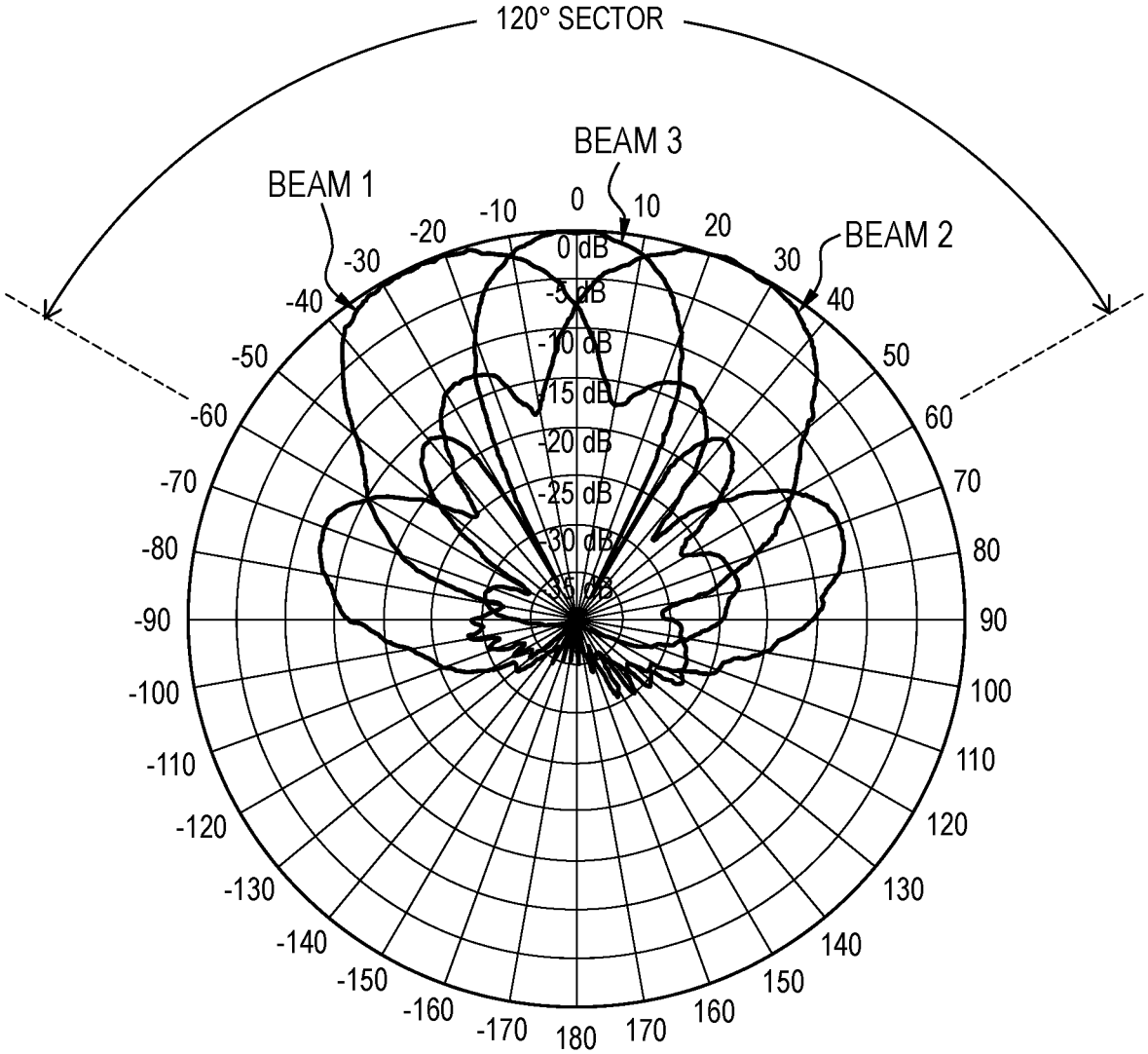
FIG. 3E is a normalized plot of three antenna beams that collectively demonstrate higher crossovers (at +/−20°) for better coverage over a respective 120° sector, for an eight-column base station antenna that utilizes amplitude-weighted and phase-weighted linear superposition according to an embodiment of the present invention.

Referring now to FIGS. 3B-3E and Tables 1-2, the power amplifiers 46 illustrated in FIG. 3A may be advantageously operated as power-amplifying linear superposition (PALS) circuits (with programmable amplitude and/or phase weighting), to thereby provide enhanced three-beam generation (with low EIRP loss) within the antenna 70, as illustrated by FIG. 3E. In particular, the simulated two-dimensional graphs of FIGS. 3B-3D and entries of Table 1 illustrate amplitude and/or phase weighted operations of the PALS circuits according to an embodiment of the present invention. In this embodiment, the PALS circuits can provide controlled three-way splitting of power amplifier output signals, along with independent phase shifting of the three-way split signals, if necessary, and then combining of the three-way split signals (in accordance with linear superposition principles). After combining, a plurality of the "combined" signals are provided to the radiating elements 72 within the antenna 70, via the diplexer and phase shifter assembly (PSA) array 50, to thereby yield three separate beams associated with a corresponding band.

Thus, as shown by FIG. 3B and Table 1, a first beam (BEAM 1, −40°) having the illustrated characteristics may be generated by the antenna 70, based on the illustrated per column amplitude and phase weights, which are implemented by the PALS circuits associated with the programmable power amplifiers 46. Similarly, as shown by FIG. 3C and Table 1, a second beam (BEAM 2, +40°), which is a mirror-image of the first beam (about 0°), may be generated based on the illustrated per column amplitude and phase weights. Next, as shown by FIG. 3D and Table 1, a third beam (BEAM 3, 0°), which is symmetric about 0° and preferentially has a peak amplitude at boresight, may be generated based on the illustrated per column amplitude and phase weights. The entries of Table 1 further illustrate that amplitude tapering (>0.25) associated with the "left" BEAM 1 can be performed using the radiating elements associated with Columns 1 and 4-5 of the antenna and amplitude tapering associated with the "right" BEAM 2 can be performed using the radiating elements associated with Columns 4-5 and 8. In addition, amplitude tapering associated with "center" BEAM 3 can be performed using the radiating elements associated with Columns 3 and 6, where a taper of 0.75 is illustrated for BEAM 3.

TABLE 1

AMPLITUDE WEIGHTING - EXAMPLE 1

| COLUMN | 1 | 2 | 3 | 4 | 5 | 6 | 7 | 8 |
|---|---|---|---|---|---|---|---|---|
| BEAM 1 (−40°) | 0.77 | 1.0 | 1.0 | 0.74 | 0.28 | 0.0 | 0.16 | 0.08 |
| BEAM 2 (+40°) | 0.08 | 0.16 | 0.0 | 0.28 | 0.74 | 1.0 | 1.0 | 0.77 |
| BEAM 3 (0°) | 0.0 | 0.10 | 0.75 | 1.0 | 1.0 | 0.75 | 0.10 | 0.0 |
| TAPER | YES (1) | NO* | YES (3) | YES (1/2) | YES (1/2) | YES (3) | NO* | YES (2) |

TABLE 1-continued

| AMPLITUDE WEIGHTING - EXAMPLE 1 | | | | | | | | |
|---|---|---|---|---|---|---|---|---|
| COLUMN | 1 | 2 | 3 | 4 | 5 | 6 | 7 | 8 |
| Total (PWR) | 0.37 | 0.64 | 0.96 | 1.0 | 1.0 | 0.96 | 0.64 | 0.37 |

Figure 1A:
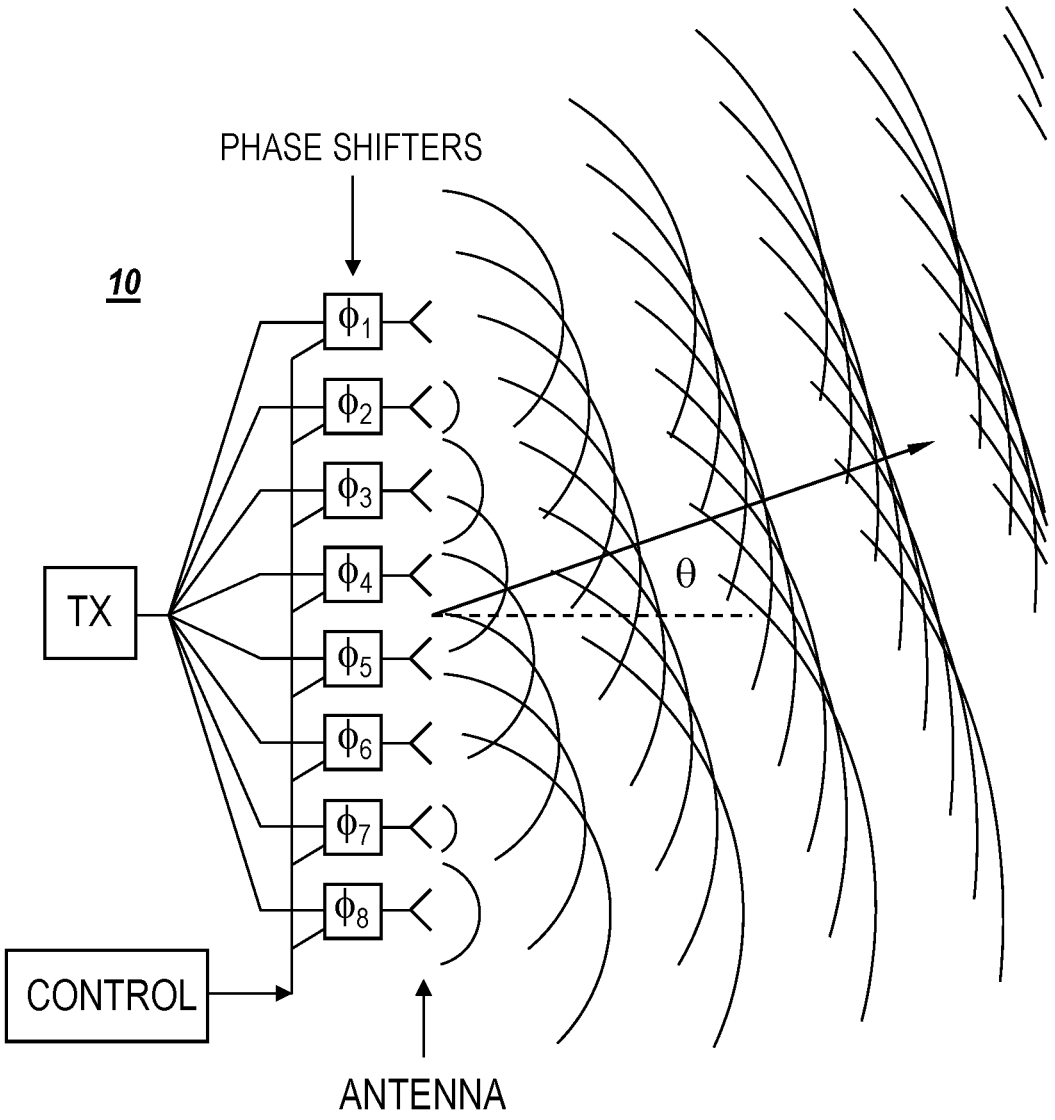
Fig. 1A (Prior Art)
FIG. 1A is a block diagram of a phased array antenna according to the prior art.
Figure 1B:
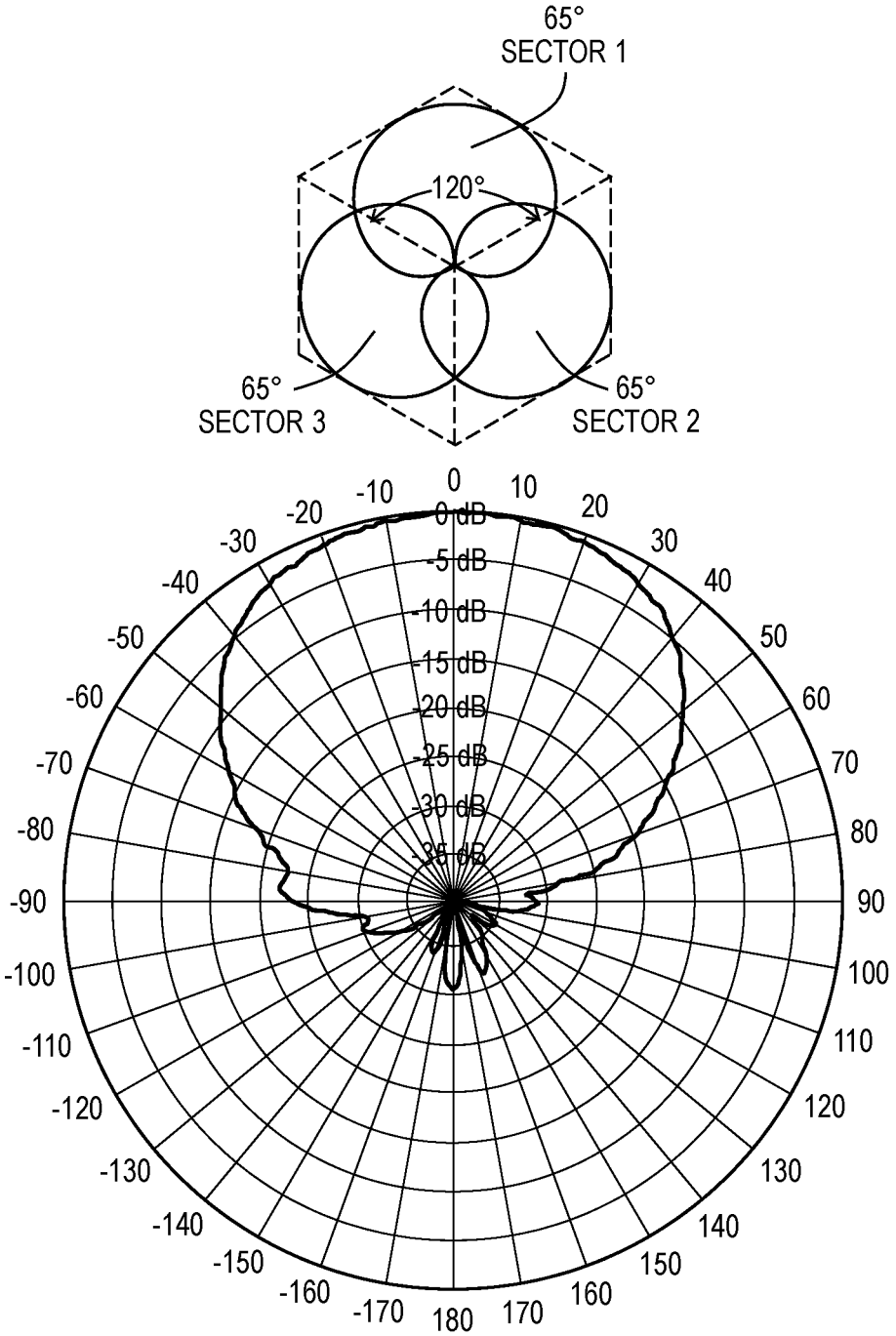
Fig. 1B (Prior Art)
FIG. 1B is a normalized plot of a single radiated antenna beam having an azimuth Half Power Beam Width (HPBW) of approximately 65°, which may be utilized with two other equivalent beams to cover three 120° sectors, as shown.
Figure 2:
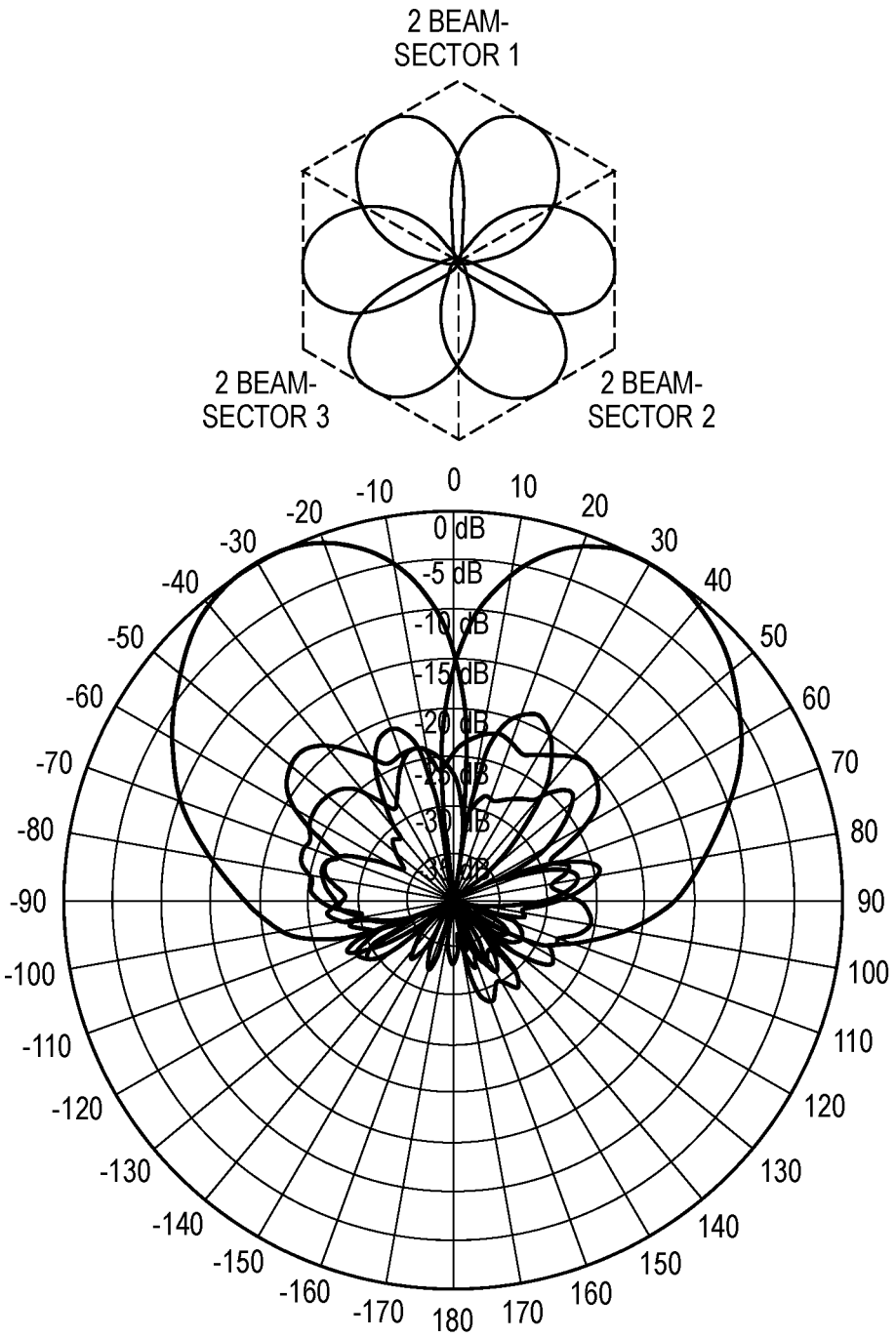
FIG. 2 is a normalized plot of two 38° radiated antenna beams, which demonstrate an absence of sufficient coverage, particularly at boresight (e.g., 00) for a tessellated pattern arrangement covering three (3) 120° sectors, as shown.

Next, applying the same simulation approach illustrated by FIGS. 3B-3C, but substituting the amplitude and phase weights of Table 2 to the PALS circuits, yields the "composite" beam pattern of FIG. 3E with: (i) high coverage at boresight (BEAM 3), (ii) improved coverage by the side beams (BEAMS 1, 2) at +/−20°, and (iii) lower crossovers (with neighboring 120° sectors) at +/−60°, which closely matches the 65° pattern of FIG. 1B and resolves the loss of boresight coverage associated with the two-beam pattern of FIG. 2.

Moreover, as shown by the amplitude/power distribution within Table 2, the beams of FIG. 3E allow for 100% rms power usage of the corresponding eight (8) antenna ports (but with two ports having two signal amplitudes adding), which minimizes the EIRP losses typically caused by running power amplifiers at less than full power. Preferably, the PALS circuits are operated with less than 20% weighting loss during the concurrent generation of the three spaced-apart RF beams at the first frequency.

The entries of Table 2 further illustrate that one-sided amplitude tapering associated with the "left" BEAM 1 can be performed by using the radiating elements associated with Column 3 of the antenna and one-sided amplitude tapering associated with the "right" BEAM 2 can be performed by using the radiating elements associated with Column 6. In contrast, dual-sided amplitude tapering associated with "center" BEAM 3 can be performed using the radiating elements associated with Columns 3 and 6, where a taper of 0.7 is illustrated.

TABLE 2

| AMPLITUDE AND PHASE WEIGHTING - EXAMPLE 2 | | | | | | | | |
|---|---|---|---|---|---|---|---|---|
| COLUMN | 1 | 2 | 3 | 4 | 5 | 6 | 7 | 8 |
| BEAM 1 | 1.0 | 1.0 | 0.7 | 0.0 | 0.0 | 0.0 | 0.0 | 0.0 |
| PHASE 1 | 0 | 90° | 180° | 0 | 0 | 0 | 0 | 0 |
| BEAM 2 | 0.0 | 0.0 | 0.0 | 0.0 | 0.0 | 0.7 | 1.0 | 1.0 |
| PHASE 2 | 0 | 0 | 0 | 0 | 0 | 180° | 90° | 0 |
| BEAM 3 | 0.0 | 0.0 | 0.7 | 1.0 | 1.0 | 0.7 | 0.0 | 0.0 |
| PHASE 3 | 0 | 0 | 0 | 0 | 0 | 0 | 0 | 0 |
| TAPER | NO | NO | YES (1/3) | NO | NO | YES (2/3) | NO | NO |

Figure 3F:
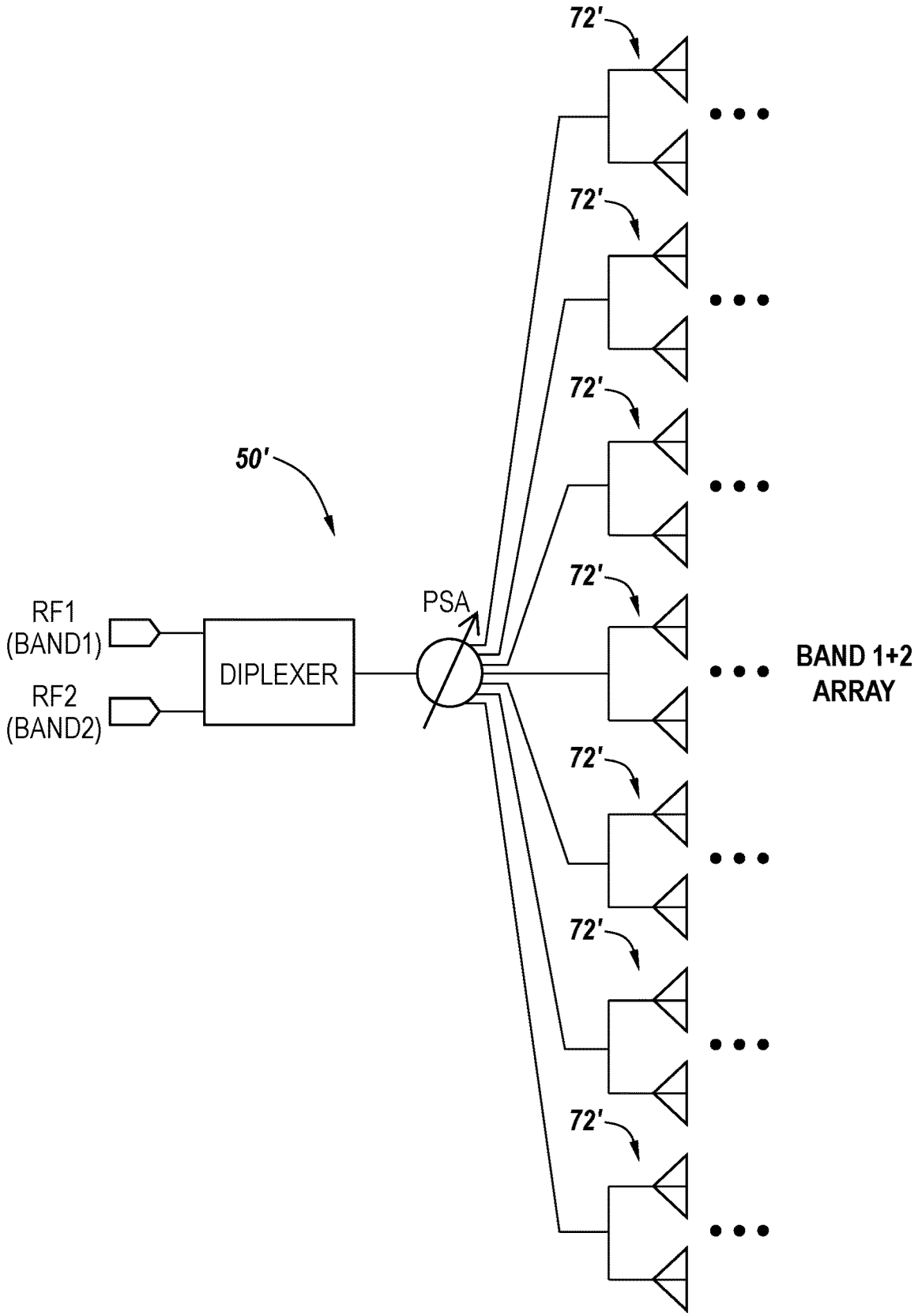
FIG. 3F is a block diagram that illustrates a "long" array of paired radiating elements that may be fed with signals from multiple radios (i.e., two frequency bands) to thereby achieve significant improvements in gain (in the elevation plane) with relatively minimal offsets caused by diplexer insertion loss, according to an embodiment of the present invention.

Next, as shown by the diplexer and phase shifter assembly 50' of FIG. 3F, multiple relatively short single band antennas (not shown) may be replaced by a 2× length broad band antenna having paired radiating elements 72', in order to achieve a significant increase in antenna directivity and gain, along with increased EIRP. Thus, by using a two-input diplexer to implement frequency-domain multiplexing of two bands (RF1, RF2), two single band antenna arrays having seven (7) radiating elements per column may be replaced by a single multi band antenna having fourteen (14) paired radiating elements per column, as shown. While in the depicted embodiment, the radiating elements 72' are arranged in pairs, it will be appreciated that other arrangements are possible. For example, a phase shifter assembly (PSA) having fourteen outputs (as opposed to the seven outputs shown in FIG. 3F) could be used, in which case all fourteen radiating elements could receive distinct sub-components of the RF signal. In other cases, the radiating elements could be grouped into any combination of sub-arrays having one, two, three or even more radiating elements. It will also be appreciated that the phase shifter assembly could be replaced with a power splitter/combiner in still other embodiments.

Figure 3G:
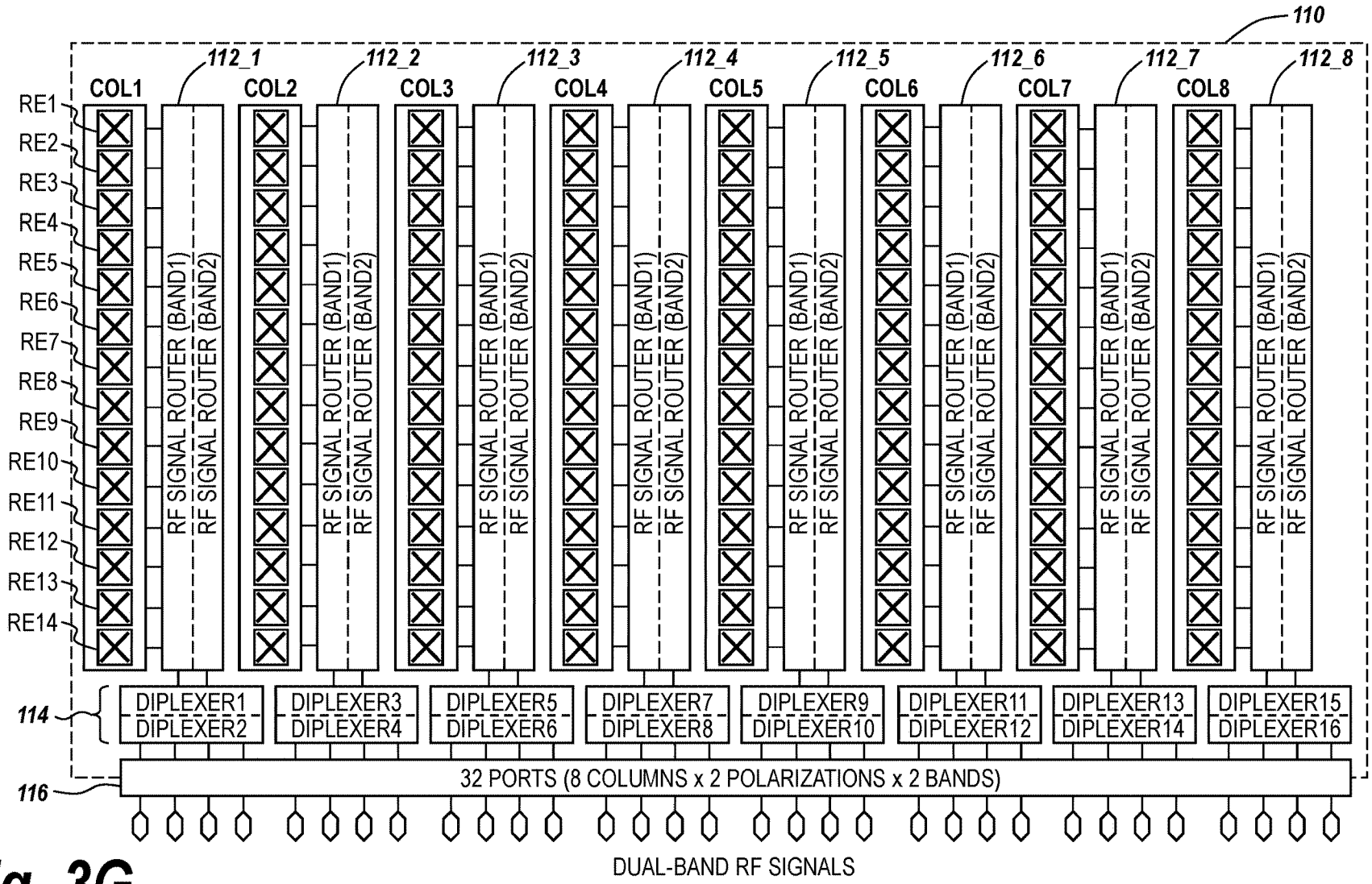
FIG. 3G is a block diagram of an eight (8) column dual-band base station antenna, according to an embodiment of the present invention.

FIG. 3G is a block diagram of an 8-column dual-band base station antenna (BSA) 110, according to an embodiment of the present invention. As illustrated, the antenna 110 includes eight columns of fourteen (14) dual-band, cross-polarized, radiating elements (RE), which are respectively coupled to multi-band RF signal routing 112_1 to 112_8. The multi-band RF signal routing 112_1 to 112_8 may comprise, for example, corporate feed networks or phase shifter assemblies that divide the RF signals fed to each column into a plurality of sub-components that are passed to the radiating elements RE, and which may also optionally adjust the relative amplitudes and/or phases of the sub-components. As shown, each "band" of the RF signal routing is electrically coupled to corresponding ones of the bidirectional ports (e.g., 32 ports), via the 2-to-1 diplexers 114 (2 diplexers/column), which may be configured as comb-line filters.

Figure 4:
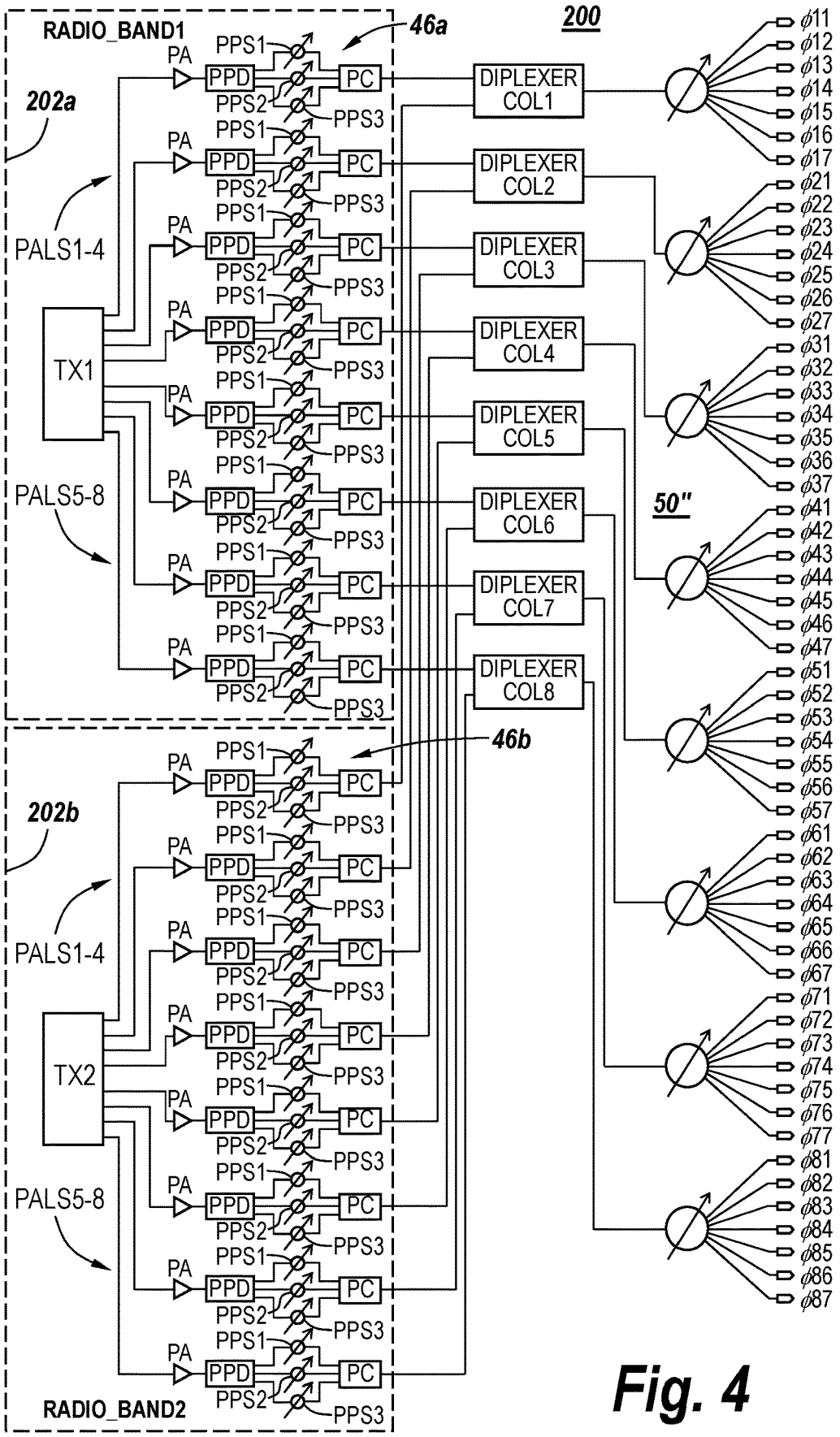
FIG. 4 is a block diagram of a multi-band RF transmitter for a base station antenna with power-amplifying linear superposition (PALS) circuits therein to support multi-beam generation according to embodiments of the present invention.

Referring now to FIG. 4, a block diagram of a multi-band RF transmission system 200 is illustrated as containing a first radio transmitter 202*a* (BAND1) with a first array of PALS circuits 46*a*, and a second radio transmitter 202*b* (BAND2) with a second array of PALS circuits 46*b*. This RF transmission system 200 is also illustrated as including an array of diplexers for supporting dual-band signal transmission to an eight (8) column broad band antenna array (see, e.g., FIG. 3F), and an array of phase shifter assemblies 50" coupled thereto, as shown. It will be appreciated that FIG. 4 is a functional block diagram that illustrates the types of operations that may be performed by the multi-band RF transmission system 200, and is not intended to be limiting in any fashion regarding the implementation of the circuitry that performs such operations.

The PALS circuits 1-8 associated with the first and second radio transmitters 202*a*, 202*b* are illustrated as having equivalent design, with each PALS circuit containing: (i) a power amplifier PA (e.g., 5 Watt), (ii) a low-loss programmable power divider PPD with three outputs, (iii) three programmable phase shifters PPS1, PPS2, PPS3 connected to respective PPD outputs, and (iv) a power combiner PC for support linear superposition of three output signals from PPS1-PPS3. The phase shifters PPS1-PPS3 may be programmed to achieve desired phase weighting. The amplitude weightings provided by the PPDs may be programmed so that the power amplifiers PA are continuously operated at full or nearly full power to thereby minimize EIRP losses caused by amplitude taper (i.e., "weighting loss"), while simultaneously achieving a desired 3-beam pattern within an antenna, as shown by FIG. 3E, for example.

The present invention has been described above with reference to the accompanying drawings, in which preferred embodiments are shown. This invention may, however, be embodied in many different forms and should not be construed as being limited to the embodiments set forth above; rather, these embodiments are provided so that this disclosure will be thorough and complete, and will fully convey the scope of the invention to those skilled in the art. Like reference numerals refer to like elements throughout.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "comprising", "including", "having" and variants thereof, when used in this specification, specify the presence of stated features, steps, operations, elements, and/or components, but do not preclude the presence or addition of one or more other features, steps, operations, elements, components, and/or groups thereof. In contrast, the term "consisting of" when used in this specification, specifies the stated features, steps, operations, elements, and/or components, and precludes additional features, steps, operations, elements and/or components.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A base station antenna, comprising:

a plurality of columns of radiating elements electrically coupled by RF signal routing to a corresponding plurality of ports of the antenna that are configured to receive a corresponding plurality of RF input signals having respective amplitudes and phases that support the concurrent generation of first, second and third spaced-apart beams by the antenna, the plurality of ports including:

a first port configured to receive a first of the plurality of RF input signals, which comprises first and second signals of equivalent frequency having unequal amplitude and/or phase weighting that contribute to the first and second beams, respectively;

a second port configured to receive a second of the plurality of RF input signals, which comprises third and fourth signals of equivalent frequency having unequal amplitude and/or phase weighting that contribute to the first and third beams, respectively; and a third port configured to receive a third of the plurality of RF input signals, which comprises a fifth signal that contributes to the first beam;

wherein the first and third signals are amplitude-tapered relative to the fifth signal;

wherein a total power of the first of the plurality of RF input signals is within 4% of a total power of the third of the plurality of RF input signals; and wherein a total power of the second of the plurality of RF input signals is within 4% of the total power of the third of the plurality of RF input signals.

2. The antenna of claim 1, wherein the first, second and third ports correspond to respective first, second and third columns of radiating elements within the antenna; and where the third column extends between the first and second columns.

3. The antenna of claim 2, wherein the third of the plurality of RF input signals consists of the fifth signal.

4. The antenna of claim 1, further comprising a fourth port configured to receive a fourth of the plurality of RF input signals, which comprises a sixth signal that contributes to the first beam.

5. The antenna of claim 4, wherein the fourth of the plurality of RF input signals consists of the sixth signal.

6. The antenna of claim 5, wherein the antenna includes eight (8) columns of radiating elements arranged side-by-side as columns one through eight; and wherein the first, second, third and fourth ports correspond to the third, sixth, fourth and fifth columns of radiating elements, respectively.

7. The antenna of claim 6, wherein the first and third signals are amplitude-tapered relative to the sixth signal.

8. The antenna of claim 1, wherein the first and second signals are linearly superposed and 180° out-of-phase relative to each other; and wherein the third and fourth signals are linearly superposed and 180° out-of-phase relative to each other.

9. A base station antenna, comprising:

first through nth side-by-side columns of radiating elements electrically coupled by RF signal routing to respective first through nth ports of the antenna, which are configured to receive respective first through nth RF input signals having respective amplitudes and phases that support the concurrent generation of first, second and third spaced-apart beams by the antenna, the first through nth ports including:

a mth port configured to receive an mth RF input signal that contributes to the first, second and third beams, said mth RF input signal comprising first, second and third signals of equivalent frequency having respective first, second and third unequal amplitudes; and a (m+1)th port configured to receive an (m+1)th RF input signal that contributes to the first, second and third beams, said (m+1)th RF input signal comprising fourth, fifth and sixth signals of equivalent frequency having respective fourth, fifth and sixth unequal amplitudes;

wherein the third and sixth signals contribute to the first beam and have unequal amplitudes;

wherein the second and fifth signals contribute to the second beam and have unequal amplitudes;

wherein the first and fourth signals contribute to the third beam and have equal amplitudes; and wherein the third beam extends between the first and second beams within the azimuth plane of the antenna.

10. The antenna of claim 9, wherein n is a positive integer equal to eight (8), and m is a positive integer equal to four (4).

11. The antenna of claim 9, wherein the third and fifth signals have equivalent amplitudes; and wherein the second and sixth signals have equivalent amplitudes.

12. The antenna of claim 9, wherein the first through nth ports includes an (m−1)th port, which is configured to receive an (m−1)th RF input signal that contributes to the first and third beams, but not the second beam.

13. The antenna of claim 9, wherein the first through nth ports includes an (m−1)th port, which is configured to receive an (m−1)th RF input signal that contributes to the first and third beams; and wherein a total power of the (m−1)th RF input signal is within 4% of a total power of the mth RF input signal.

14. A base station antenna, comprising:

first through nth side-by-side columns of radiating elements electrically coupled by RF signal routing to respective first through nth ports of the antenna, which are configured to receive respective first through nth RF input signals having respective amplitudes and phases that support the concurrent generation of first, second and third spaced-apart beams by the antenna, the first through nth ports including:

a second port configured to receive a second RF input signal that contributes to the first beam;

a third port configured to receive a third RF input signal that contributes to the first and third beams;

a fourth port configured to receive a fourth RF input signal that contributes to the third beam;

a fifth port configured to receive a fifth RF input signal that contributes to the third beam;

a sixth port configured to receive a sixth RF input signal that contributes to the second and third beams; and a seventh port configured to receive a seventh RF input signal that contributes to the second beam.

15. The antenna of claim 14, wherein the second RF input signal contributes to the first beam, but not the second or third beams; wherein the third RF input signal contributes to the first and third beams, but not the second beam; wherein the sixth RF input signal contributes to the second and third beams, but not the first beam; and wherein the seventh RF input signal contributes to the second beam, but not the first or third beams.

16. The antenna of claim 15, wherein a total power of the third RF input signal is within 2% of the total power of the second RF input signal; and wherein a total power of the sixth RF input signal is within 2% of the total power of the seventh RF input signal.

17. The antenna of claim 14, wherein the first port is configured to receive a first RF input signal that is 90° out-of-phase relative to the second RF input signal; and wherein the nth port is configured to receive an nth RF input signal that is 90° out-of-phase relative to the seventh RF input signal.

18. The antenna of claim 17 wherein a portion of the third RF input signal that contributes to the first beam is 180° out-of-phase relative to the first RF input signal; and wherein a portion of the sixth RF input signal that contributes to the second beam is 180° out-of-phase relative to the nth RF input signal, where n equals eight (8).

19. The antenna of claim 18, wherein a portion of the third RF input signal that contributes to the third beam is in phase with the fourth RF input signal; and wherein a portion of the sixth RF input signal that contributes to the third beam is in phase with the fifth RF input signal.

20. The antenna of claim 17, wherein a portion of the third RF input signal that contributes to the third beam is in phase with the fourth RF input signal; and wherein a portion of the sixth RF input signal that contributes to the third beam is in phase with the fifth RF input signal.

* * * * *